United States Patent [19]

Collins et al.

[11] Patent Number: 4,555,059

[45] Date of Patent: Nov. 26, 1985

[54] FLOW-AMPLIFYING LIQUID-ATOMIZING NOZZLE

[75] Inventors: C. Neal Collins, Goshen; Joseph E. Peter, Cincinnati, both of Ohio

[73] Assignee: Vortec Corporation, Cincinnati, Ohio

[21] Appl. No.: 638,230

[22] Filed: Aug. 6, 1984

[51] Int. Cl.[4] ..... B05B 7/00

[52] U.S. Cl. ..... 239/425; 239/433; 239/434.5; 417/197

[58] Field of Search ..... 239/290, 422–425, 239/426, 431, 433–434.5, DIG. 7; 417/197, 198

[56] References Cited

U.S. PATENT DOCUMENTS

| | | | |
|---|---|---|---|
| 4,195,780 | 4/1980 | Inglis | 239/433 X |
| 4,267,979 | 5/1981 | Lomax | 239/426 X |
| 4,385,728 | 5/1983 | Inglis et al. | 239/433 X |

*Primary Examiner*—Andres Kashnikow

*Attorney, Agent, or Firm*—Tilton, Fallon, Lungmus

[57] ABSTRACT

A liquid-atomizing nozzle in which intermixing of air and liquid occurs externally of the nozzle and the primary air utilized for such intermixing is amplified by the entrainment of ambient secondary air. Two versions of the nozzle are disclosed, each having a tubular body with a generally cylindrical section terminating in a conical nose section. Air under pressure is discharged through radial openings in the cylindrical section and is redirected by a collar surrounding the cylindrical section to form a high velocity stream of air about and along the gradually-tapered outer surface of the nose section. Such high velocity primary air, amplified by ambient secondary air, strips liquid from at least one opening in the nose section to produce an externally-developed air-liquid mixture. In one version the liquid discharge opening is at the tip of the conical nose section; in another version a plurality of such openings are formed in the conical surface of that section.

12 Claims, 7 Drawing Figures

FLOW-AMPLIFYING LIQUID-ATOMIZING NOZZLE

BACKGROUND AND SUMMARY

Co-owned U.S. Pat. No. 4,385,728 discloses a flow-amplifying nozzle having a tapered nose section over which a high velocity film of primary air is directed. Secondary air is entrained by the rapid flow of primary air and thereby amplifies the total flow of air directed by the nozzle. Another U.S. Pat. No. 4,195,780 discloses an external-flow nozzle that operates on the same principle but which also includes an annular metering passage that is adjustable for varying the flow of primary air from the nozzle.

The prior art is replete with designs for nozzles capable of spraying or atomizing liquids. Those nozzles that utilize pressurized air might be regarded as falling into three broad categories, namely, those that operate on a flit gun principle, those that mix liquid and air internally, and those which generate shock waves to produce atomization and are commonly referred to as sonic nozzles.

In the flit gun type of nozzle, pressurized air strips liquid from the end of a feed tube that usually extends at right angles to the tip of the nozzle just beyond its outlet. Since the intermixing of liquid and air occurs externally and, especially since the feed tube opening is usually relatively large, problems of clogging are minimized. However, directivity is ordinarily lacking. Such a construction is commonly used for fogging where the need for directivity is minimal, although patents such as U.S. Pat. No. 1,326,483 reveal that the same principle of operation has been employed in paint spraying devices.

Sprayers for applying liquid coatings are sometimes designed to intermix the liquid and air internally, prior to discharge from the nozzle. Such an arrangement promotes directivity but with offsetting disadvantages such as a greater likelihood of clogging. Also, achieving uniform liquid particle size may be more difficult, especially if such particles impact and cling to internal surfaces near the outlet of the nozzle where they agglomerate or reclassify and are then discharged randomly as relatively large droplets. Reference may be had to patents disclosing paint sprayers and air brushes such as U.S. Pat. Nos. 1,603,902, 1,294,190, 1,218,279, and 3,796,376.

Accordingly, it is an object of this invention to provide a liquid-atomizing nozzle that has the directivity needed for spraying liquid coatings (but, if desired, may be constructed to provide low directivity for uses such as fogging, humidifying, and suppressing or controlling dust); is relatively simple and inexpensive in construction; is highly effective in achieving uniformity of liquid particle size and, specifically, avoids problems of particle reclassification and droplet formation; and is relatively quiet in operation. When adapted for fogging or humidifying, the nozzle is well suited for discharging liquid particles so small that such particles will flash into vapor less than 30 inches from the end of the nozzle. In short, this invention is directed to a nozzle which has important advantages of various types of prior nozzles without the significant disadvantages associated with the earlier constructions.

Briefly, the liquid-atomizing nozzle includes a tubular body having a generally cylindrical section with an axial bore and a conical, inwardly-tapered nose section projecting from one end of the cylindrical section. The nose section has liquid outlet means for externally discharging liquid from that section. In one form of the invention, the outlet means comprises an axial discharge opening at the tip of the nose section; in another form, such means comprises a plurality of circumferentially-spaced discharge openings about the conical surface of the nose section. In either case, the outlet means communicates with a liquid supply conduit extending through the bore of the tubular body.

The nozzle is provided with an annular collar that extends about the cylindrical section of the body and has a flow-directing section and an attachment section. The flow-directing section of the collar has a bore sufficiently greater in diameter than the outside of the cylindrical section to define an annular flow-directing passage that communicates with a multiplicity of openings extending through the wall of the body's cylindrical section. The flow-directing passage faces towards the nose section for directing a stream or curtain of high-velocity primary air along the conical surface of the nose section. As the high velocity air flows over the surface of the gradually tapered nose (the taper should not exceed about 25° measured from the longitudinal axis), the primary air entrains surrounding secondary air which amplifies the total flow and also reduces operating noise. As the high-velocity primary air travels past the liquid outlet or outlets, it strips away the liquid and atomizes into particles of selected size, such size being dependent partly on the pressure and velocity of the primary air, the location and size of the liquid discharge outlet(s), and the pressurization (if any) of the liquid medium.

In the embodiment in which the liquid outlet takes the form of an opening at the tapered distal end of the nose section, the surface of the outlet means immediately adjacent that opening flares outwardly and distally, merging with the tapered outer surface of the nose section in a circular terminal edge. Liquid flows outwardly along the flared surface and is stripped away by the primary air at the point where that surface converges with the conical outer surface of the nose.

The second embodiment, in which the liquid outlet means takes the form of a plurality of discharge openings arranged in a circumferentially-spaced series about the conical surface at the proximal end of the nose section, is particularly suitable for producing the extremely small liquid particle sizes required for suppressing dust, humidifying, and fogging.

Other features, objects, and advantages will become apparent from the specification and drawings.

DRAWINGS

DETAILED DESCRIPTION OF PREFERRED EMBODIMENTS

Figure 3:
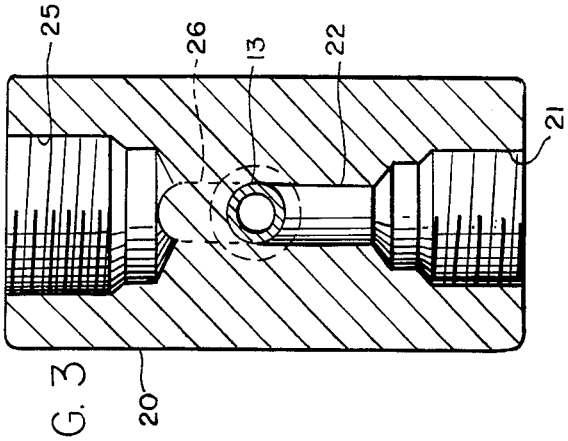
FIG. 3 is a sectional view taken along line 3—3 of FIG. 2.
Figure 1:
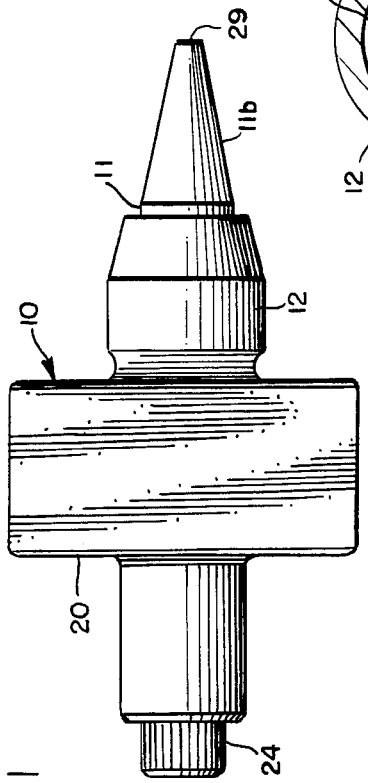
FIG. 1 is a side elevational view of a flow-amplifying liquid-atomizing nozzle embodying this invention.
Figure 2A:
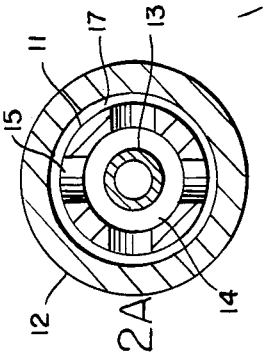
FIG. 2A is a sectional view taken along line 2A—2A of FIG. 2.
Figure 2:
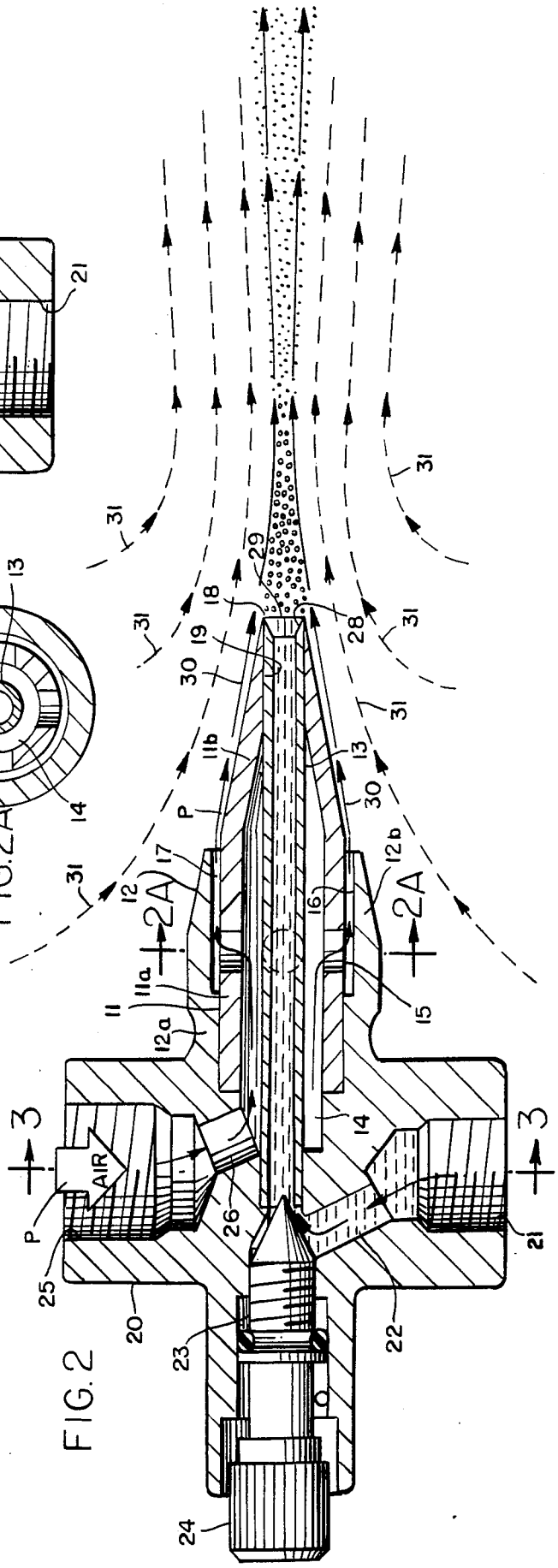
FIG. 2 is a longitudinal sectional view of the nozzle schematically depicting its method of operation.

Referring to FIGS. 1–3, the numeral 10 generally designates a nozzle composed of a tubular inner body 11, an outer collar 12, and conduit means 13 for conveying liquid through the body to a discharge opening or port. The tubular body 11 has a generally cylindrical proximal section 11*a* and a conical distal nose section 11*b* that constitutes an integral extension of the body section. The longitudinal bore 14 of the body conducts pressurized air to a multiplicity of radial openings 15 formed in the wall of the cylindrical section; four such openings or passages are shown in the drawings but a greater or smaller number may be provided.

Collar 12 extends about the cylindrical section of the body, such collar having a proximal attachment section 12*a* that extends about the cylindrical body section 11*a* and is permanently secured thereto by an interference fit or by any other suitable means. The collar also includes a flow-directing section 12*b* that has a bore 16 sufficiently greater in diameter than the outer surface of the cylindrical section to define an annular flow-directing passage 17 communicating with the radial openings 15. It will be noted from FIG. 2 that the flow-directing passage 17 faces towards conical nose section 11*b* and has its discharge end in close proximity to the enlarged proximal end of that section. The cross sectional area of the flow-directing passage 17 should be slightly greater than the combined cross sectional areas of all of the radial openings 15. Therefore, the passage 17 functions to direct (or redirect) flow and preferably performs no substantial function in controlling flow rate. Flow rate is instead established by radial openings 15 and, because of the radial disposition of those openings, they may be easily formed and precisely dimensioned during manufacture.

The collar 12 is part of a housing 20 with passages for conveying liquid to conduit 13 and pressurized air to tubular body 11. Specifically, a liquid supply tube (not shown) may be threadedly coupled to threaded bore 21 for delivering liquid to passage 22 and conduit 13. A needle valve 23 equipped with knob 24 or other suitable rotating means may be rotated to vary liquid flow to conduit 13. The needle valve 23 is entirely conventional and any suitable valve means for precisely controlling or metering the flow of liquid may be used.

A standard line for pressurized air, such as a conventional industrial line charged with air at pressures of approximately 80 to 100 psig, may be coupled in similar fashion to threaded opening 25 which communicates with bore 14 by means of passage 26.

In the embodiment of FIGS. 1–3, the liquid conduit means 13 takes the form of a small-bore tube that extends axially through body 11 to the tip 18 of tapered nose section 11*b*. FIG. 2 reveals that the nose section is bored at 19 to receive the distal end of tube 13, the two parts being sealingly and permanently joined by solder, adhesive, or any other suitable means. The tube 13 therefore performs the dual functions of providing a passage for liquid L and closing off the distal end of bore 14. Primary air P carried by the bore may therefore escape from the nozzle only through radial openings 15 and flow-directing passage 17.

The distal end of tube 13 is provided with an outwardly-flared frusto conical surface 28 leading to an enlarged opening 29 at the extreme distal end of the tube. The flared or beveled surface 28 slopes outwardly and distally to merge with the distal end of the nose section's tapered outer surface along an edge that defines opening 29.

In operation, air under pressure is carried by bore 14 to radial openings 15 and is discharged from flow-directing passage 17 towards the tapered nose section 11*b*. The primary high-velocity air P flows along the gradually-tapered outer surface of nose section 11*b* as indicated by solid arrows 30 in FIG. 2. Such air follows the contour of the nose section as indicated; to insure that the primary air will follow the surface of the nose section and will not disassociate or break away from that surface, the angle of taper, measured from the longitudinal axis of the nozzle, should be no greater than about 25° and should preferably fall within the range of 10° to 20°. As the high-velocity air travels along the tapered surface, it entrains large quantities of secondary air surrounding the nozzle, drawing such secondary air forwardly as indicated by broken arrows 31 (FIG. 2). The flow of air from the nozzle is thereby amplified to create a total flow which may be 25 or more times as great as the flow of primary air alone. Such secondary air not only amplifies the flow, but also blankets and reduces the noise generated by the primary air discharged at near sonic velocities from flow-directing passage 17 and passing beyond the tip 18 of nose section 11*b*.

As the high-velocity air passes the edge of opening 29, it strips away liquid at that edge and breaks the fluid into fine particles as schematically illustrated in FIG. 2. Such primary air may constitute the sole means for aspirating or drawing liquid through opening 29 and along tube 13 although, to insure uniformity of operation for different nozzle positions and to atomize a liquid of predetermined viscosity to particles of selected size for any given spraying operation, some pressurization of the liquid is ordinarily desirable and may even be necessary. As the liquid particles travel away from the nozzle, the pattern increases gradually, some of the particles becoming intermixed with secondary air, and the expansion tends to promote even greater reduction in particle size. Depending on the pressures selected for the primary air, the liquid involved, the extent of liquid pressurization (if any), the taper of nose section 11*b*, the sizes of opening 29, and the flow passage of tube 13, and the cross sectional area of flow-directing passage 17, the nozzle may be used to produce an atomized liquid spray pattern for coating a target with liquid (paint, lubricant, or other liquid coatings) at distances in excess of four feet or, alternatively, may produce liquid particles of such small size that flash vaporization occurs well within that distance.

Figure 6:
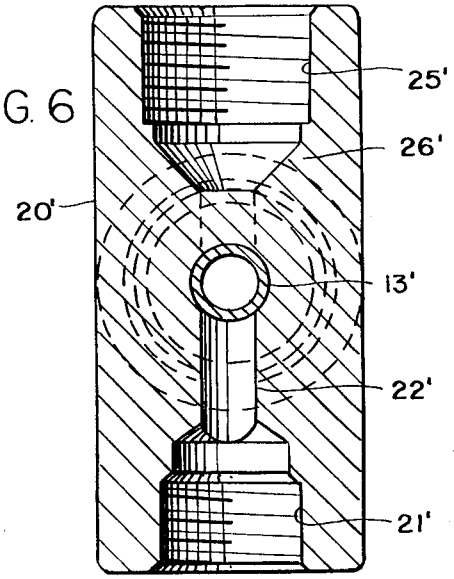
FIG. 6 is an enlarged sectional view taken along line 6—6 of FIG. 5.
Figure 4:
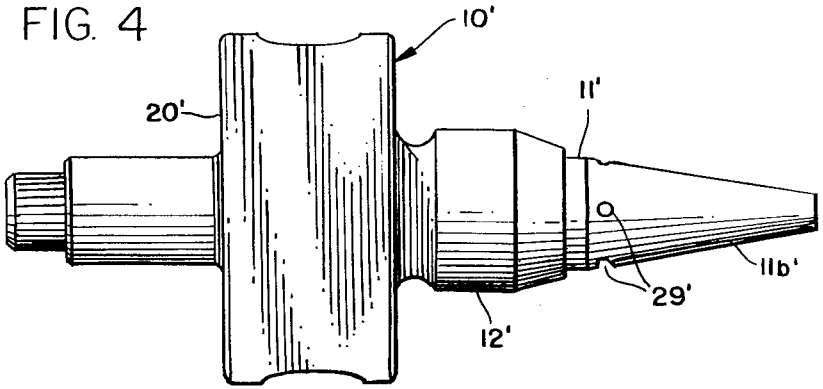
FIG. 4 is a side view of a nozzle constituting a second embodiment of this invention.

The embodiment of FIGS. 1–3 has been found particularly useful for coating operations in contrast to fogging, humidifying, evaporative cooling and, in general, vaporizing operations. For the latter, the embodiment of FIGS. 4–6 has been found especially effective, although the second embodiment, like the first, may be adapted to perform either function by controlling pressures, materials, rates of flow, and dimensions.

Nozzle 10' like nozzle 10, has a tubular body 11' with a cylindrical section 11*a'* and a conical nose section 11*b'*. Conduit means 13' conveys liquid L to a plurality of openings 29' spaced circumferentially about the proximal end of the conical section 11*b'* in close proximity to cylindrical section 11*a'*. In the embodiment illustrated, there are four such openings 29'; however, the number may be reduced (with some possible sacrifice in uniformity of operation) or may be increased.

Figure 5:
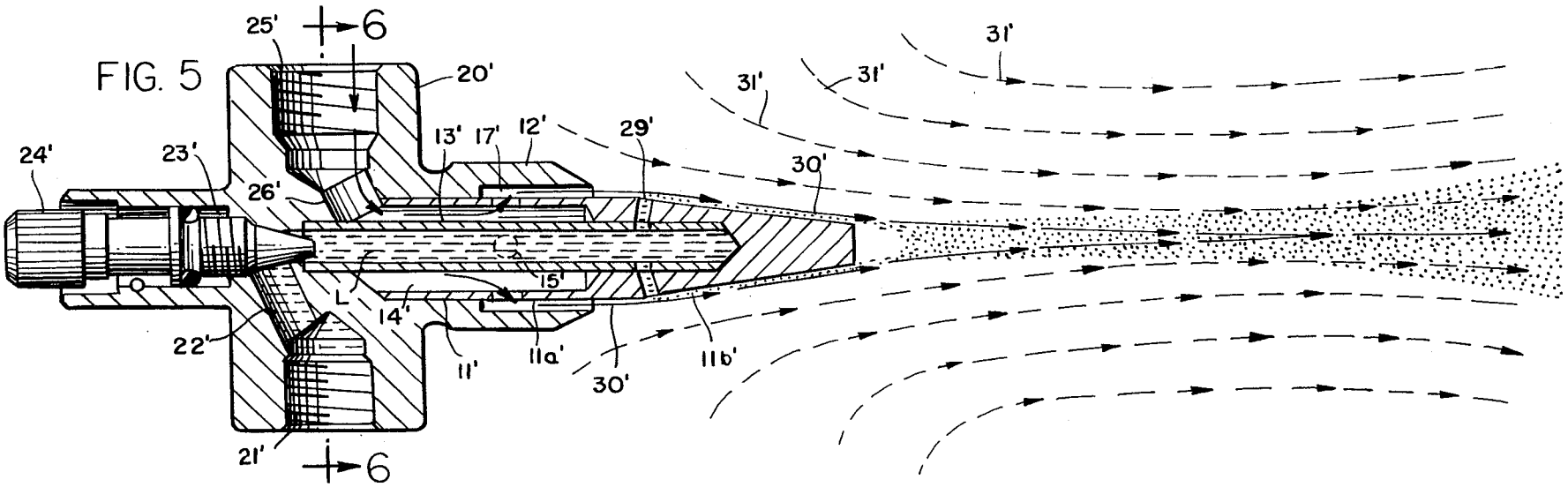
FIG. 5 is a longitudinal sectional view of the nozzle of FIG. 4.

The essential differences between the two embodiments lie in the fact that in the second embodiment there are a plurality of liquid discharge openings 29' rather than a single opening 29, and such openings 29' are located adjacent the proximal end of nose section 11b' rather than at the distal tip of that section. High-velocity air discharged from the flow-directing passage 17' travels only a relatively short distance before stripping away liquid at openings 29'. The liquid particles and high-velocity air, along with substantial volumes of secondary air schematically represented by arrows 31', are directed forwardly or distally as shown in FIG. 5. The fine particles of liquid fan outwardly into the mixture of primary and secondary air as generally depicted in the drawing. It is to be noted, however, that the liquid-stripping action occurring at openings 29' and the advancement of liquid particles along the length of the gradually-tapered nose section 11b' (which should have an angle of taper similar to that described in connection with the first embodiment), are performed mainly by the high-velocity air discharged from the flow-directing passage 17', the flow of such high-velocity air being indicated by arrows 30'. Therefore, the possibility of reclassification of liquid particles as they travel along the surface of the tapered nose section is essentially avoided. Uniformity of particle size is promoted, the occurrence of agglomerated or reclassified large liquid particles is prevented, and, since the atomization takes place externally, problems of clogging, cleaning, and maintenance are substantially eliminated or at least greatly reduced.

While in the foregoing we have disclosed embodiments of this invention in considerable detail for purposes of illustration, it will be understood by those skilled in the art that many of these details may be varied without departing from the spirt and scope of the invention.

We claim:

1. A flow-amplifying liquid-atomizing nozzle comprising a tubular body having a generally cylindrical section with an axial bore and a conical, inwardly-tapered nose section at one end of said cylindrical section; said tapered nose section having liquid outlet means for the external discharge of liquid from said nose section; conduit means extending through said bore to said liquid outlet means for delivering liquid to said outlet means; said cylindrical section having a plurality of circumferentially-spaced radial openings communicating with said bore; a collar extending about said cylindrical section; said collar having a flow-directing section and an attachment section; said flow-directing section having a bore sufficiently greater in diameter than the outside of said cylindrical section to define an annular flow-directing passage communicating with said openings and facing towards said nose section; said attachment section being secured to said cylindrical section in fluid-tight sealing relation along the surface of said cylindrical section remote from said nose section; whereby, primary air under pressure supplied to said flow-directing passage through said bore is directed along the surface of said conical nose section to strip liquid from said liquid outlet means as said primary air is being amplified by ambient secondary air entrained thereby.

2. The nozzle of claim 1 in which said nose section terminates in a tip of reduced diameter; said liquid outlet means comprising an axial discharge opening at said tip communicating with said conduit means.

3. The nozzle of claim 2 in which said conduit means has a flow passage of generally uniform diameter throughout its length; said axial discharge opening being larger than said flow passage and being defined by an outwardly-flared, annular, frusto-conical surface interposed between the end of said tip and said flow passage.

4. The nozzle of claim 3 in which said axial discharge opening has a diameter substantially the same as the external diameter of said conical nose section at said tip.

5. The nozzle of claim 3 in which said outwardly-flared frusto-conical surface and the tapered outer surface of said conical nose section meet along a circular edge at the tip of said nose section.

6. The nozzle of claim 3 in which said conduit extends through said nose section at said tip and said outwardly-flared frusto-conical surface is provided by said conduit.

7. The nozzle of claim 1 in which said liquid outlet means comprises a plurality of circumferentially-spaced liquid discharge openings extending through the conical surface of said nose section; said liquid discharge openings communicating with said conduit means.

8. The nozzle of claim 7 in which said liquid discharge openings are located at the end of said conical nose section adjacent said cylindrical section.

9. The nozzle of claim 7 in which valve means are operatively associated with said conduit means for regulating the flow of liquid therethrough.

10. The nozzle of claim 7 in which the reduced tip of said conical section is blunt.

11. The nozzle of claim 1 in which said conical nose section tapers at an angle no greater than about 25° measured from the longitudinal axis of said nozzle.

12. The nozzle of claim 2 in which valve means are operatively associated with said conduit means for regulating the flow of liquid therethrough.

* * * * *